US006929343B2

(12) United States Patent
Farr et al.

(10) Patent No.: US 6,929,343 B2
(45) Date of Patent: Aug. 16, 2005

(54) FLUID DETECTION SYSTEM

(75) Inventors: Isaac Farr, Corvallis, OR (US); Edward Z. Cai, Camas, WA (US); Ray Allen Walker, Eugene, OR (US); Shane Shivji, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 170 days.

(21) Appl. No.: 10/425,355

(22) Filed: Apr. 28, 2003

(65) Prior Publication Data

US 2004/0223021 A1 Nov. 11, 2004

(51) Int. Cl.[7] ..... B41J 29/393
(52) U.S. Cl. ..... 347/19
(58) Field of Search ..... 347/7, 19, 50, 347/60

(56) References Cited

U.S. PATENT DOCUMENTS 4,319,484 A 3/1982 Keller
4,800,755 A 1/1989 Fathauer et al.
4,841,256 A 6/1989 Gastgeb
4,956,763 A 9/1990 Stewart, Jr. et al.
5,583,544 A * 12/1996 Stamer et al. ..... 347/7
5,611,240 A 3/1997 Yamaguchi
5,719,556 A 2/1998 Albin et al.
6,246,831 B1 6/2001 Seitz et al.
6,609,792 B2 * 8/2003 Kaga et al. ..... 347/104
6,729,184 B2 * 5/2004 Tsukada et al. ..... 73/290 V
2003/0214545 A1 * 11/2003 Eguchi et al. ..... 347/19

* cited by examiner

*Primary Examiner*—Thinh Nguyen

(57) ABSTRACT

A fluid supply is provided, which includes a body defining a storage space configured to contain a fluid, a first electrode and a second electrode contained within the storage space and configured to be in direct contact with the fluid, wherein the first electrode and second electrode are configured to be connected to external power supply circuitry for applying an alternating signal across the first and second electrodes, and a first electrical contact in electrical communication with the first electrode and a second electrical contact in electrical communication with the second electrode. The first electrical contact and second electrical contact are to be connected to the external power supply circuitry and to detector circuitry for determining a measured impedance value of the fluid.

52 Claims, 4 Drawing Sheets

FLUID DETECTION SYSTEM

BACKGROUND

Many types of printing devices, including but not limited to printers, copiers, and facsimile machines, print by transferring a printing fluid onto a printing medium. These printing devices typically include a printing fluid supply or reservoir configured to store a volume of printing fluid. The printing fluid reservoir may be located remotely from the print head assembly ("off-axis"), in which case the fluid is transferred to the print head assembly through a suitable conduit, or may be integrated with the print head assembly ("on-axis"). Where the printing fluid reservoir is located off-axis, the print head assembly may include a small reservoir that is periodically refilled from the larger off-axis reservoir.

Some printing devices may include a printing fluid detector configured to produce an out-of-fluid signal when the printing fluid volume drops below a predetermined level in the printing fluid reservoir, or to indicate how much printing fluid remains in the reservoir. The use of a printing fluid detector may offer a number of benefits. For example, the out-of-fluid signal may be used to trigger the printing device to stop printing and alert a user to the out-of-fluid state. The user may then replace (or replenish) the printing fluid reservoir and resume printing. Likewise, where a print head assembly includes a smaller reservoir that is periodically refilled from a larger reservoir, a printing fluid detector may trigger more printing fluid to be transferred from the larger reservoir to the smaller reservoir.

Various types of printing fluid detectors are known. Examples include, but are not limited to, optical detectors, pressure-based detectors, resistance-based detectors and capacitance-based detectors. Capacitance-based printing fluid detectors may utilize a pair of capacitor plates positioned adjacent, but external, to the printing fluid. These detectors measure changes in the capacitance of the plates with changes in printing fluid levels. However, the changes in capacitance of these systems may be too small to easily distinguish the capacitance changes from background noise. Thus, it may be difficult to accurately determine a printing fluid level, resulting in the generation of false out-of-fluid signals, and/or the failure to generate out-of-fluid signals when appropriate.

SUMMARY

A fluid supply is provided, which includes a body defining a storage space configured to contain a fluid, a first electrode and a second electrode contained within the storage space and configured to be in direct contact with the fluid, wherein the first electrode and second electrode are configured to be connected to external power supply circuitry for applying an alternating signal across the first and second electrodes, and a first electrical contact in electrical communication with the first electrode and a second electrical contact in electrical communication with the second electrode. The first electrical contact and second electrical contact are to be connected to the external power supply circuitry and to detector circuitry for determining a measured impedance value of the fluid.

DETAILED DESCRIPTION

Figure 1:
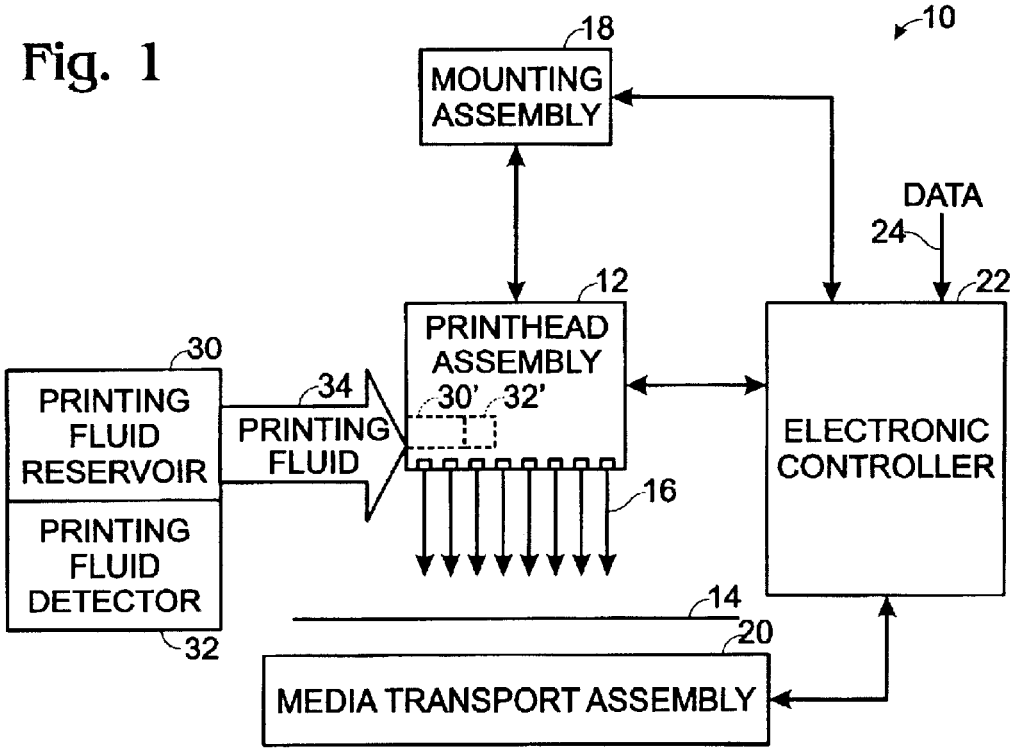
FIG. 1 is a block diagram of a printing device according to a first embodiment of the present invention.

FIG. 1 shows a block diagram of a printing device according to an embodiment of the present invention generally at 10. Printing device 10 may be any suitable type of printing device, including but not limited to, a printer, facsimile machine, copier, or a hybrid device that combines the functionalities of more than one of these devices. Printing device 10 includes a print head assembly 12 configured to transfer a printing fluid onto a printing medium 14 positioned adjacent to the print head assembly. Print head assembly 12 typically is configured to transfer the printing fluid onto printing medium 14 via a plurality of fluid ejection mechanisms 16. Fluid ejection mechanisms 16 may be configured to eject printing fluid in any suitable manner. Examples include, but are not limited to, thermal and piezoelectric fluid ejection mechanisms.

Print head assembly 12 may be mounted to a mounting assembly 18 configured to move the print head assembly relative to printing medium 14. Likewise, printing medium 14 may be positioned on, or may otherwise interact with, a media transport assembly 20 configured to move the printing medium relative to print head assembly 12. Typically, mounting assembly 18 moves print head assembly 12 in a direction generally orthogonal to the direction in which media transport assembly 20 moves printing medium 14, thus enabling printing over a wide area of printing medium 14.

Printing device 10 also typically includes an electronic controller 22 configured receive data 24 representing a print job, and to control the ejection of printing fluid from print head assembly 12, the motion of mounting assembly 18, and the motion of media transport assembly 20 to effectuate printing of an image represented by data 24.

Printing device 10 also includes a printing fluid reservoir 30 and an associated printing fluid detector 32. Printing fluid reservoir 30 is configured to hold a volume of a printing fluid, and to transfer the printing fluid to print head assembly 12 as needed. Thus, printing fluid reservoir 30 is fluidically connected to print head assembly 12 with a printing fluid conduit 34 that enables the transfer of printing fluid to the print head assembly. Printing fluid reservoir 30 may have either an off-axis or an on-axis configuration. Where printing fluid reservoir 30 has an off-axis configuration, print head assembly may include a smaller printing fluid reservoir 30' that is periodically replenished with printing fluid from printing fluid reservoir 30. Printing fluid reservoir 30' may have an associated printing fluid detector 32' as well.

Printing fluid detector 32 is configured to measure an impedance value associated with the printing fluid in printing fluid reservoir 30, and to determine a characteristic of the printing fluid in the printing fluid reservoir based upon the measured impedance value. For example, printing fluid detector 32 may be configured to determine a level of printing fluid in printing fluid reservoir 30, a type of printing fluid in the printing fluid reservoir, and/or whether the printing fluid reservoir is out of printing fluid. It will be appreciated that the description herein of printing fluid detector 32 is equally applicable to printing fluid detector 32'.

Figure 2:
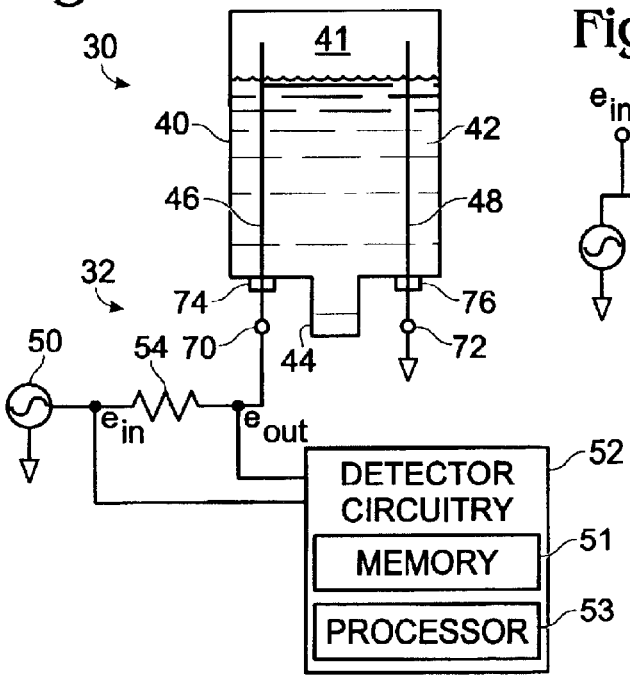
FIG. 2 is a schematic depiction of a first exemplary embodiment of the printing fluid reservoir and printing fluid detector of the embodiment of FIG. 1.

FIG. 2 shows a schematic depiction of a first exemplary embodiment of a printing fluid reservoir 30 and a printing fluid detector 32. Printing fluid reservoir 30 includes a body 40 defining an inner volume 41 containing a printing fluid 42, and an outlet 44 configured to pass printing fluid into conduit 34. Printing fluid reservoir 30 is depicted as being partially filled with printing fluid 42. However, it will be appreciated that printing fluid reservoir typically begins a use cycle substantially completely filled with a printing fluid, and eventually transfers most or all of the printing fluid to print head assembly 12.

Printing fluid detector 32 may include several individual components. First, printing fluid detector 32 includes a first electrode 46 and a second electrode 48 disposed within printing fluid reservoir 30. Printing fluid detector 32 also includes power supply circuitry 50 configured to apply an alternating signal to the first electrode (or, equivalently, across the first and second electrodes). A resistor 54 is disposed between power supply circuitry 50 and first electrode 46, in series with first electrode 46, second electrode 48 and printing fluid 42.

Next, printing fluid detector 32 includes detector circuitry 52 configured to determine a measured impedance value of the printing fluid from a comparison of the supply signal measured at $e_{in}$ and a detected signal measured at $e_{out}$. As shown in FIG. 2, $e_{in}$ is measured at the power supply side of resistor 54, and $e_{out}$ is measured at the printing fluid reservoir side of resistor 54. The measured impedance value may then be used to determine a characteristic of printing fluid 42 in printing fluid reservoir 30, including but not limited to, a printing fluid level, a printing fluid type, and an out-of-fluid condition.

Detector circuitry 52 may include memory 51 and a processor 53 for comparing the supply signal and the detected signal to determine the measured impedance value. Memory 51 may store instructions executable by processor 53 to perform the comparison of the supply signal and detected signal to determine a measured impedance value. The instructions may also be executable by processor 53 to compare the measured impedance value to known impedance values arranged in a look-up table stored in memory 51 to determine the characteristic of the printing fluid in the printing fluid reservoir.

First electrode 46 and second electrode 48 are each positioned within interior 41 of printing fluid reservoir 30 such that the electrical conductors that form the first and second electrodes are in direct contact with printing fluid 42. In other capacitive fluid level detection systems, the capacitor plates are typically positioned externally from the fluid being measured. However, as described above, the changes in capacitance due to changes in printing fluid levels measured in these systems are often too small to easily distinguish the changes from background noise.

Figure 3:
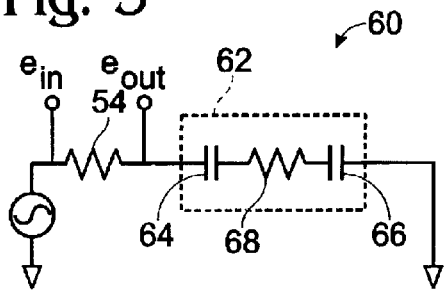
FIG. 3 is a schematic depiction of an equivalent circuit of the embodiment of FIG. 2.

In contrast, by placing first electrode 46 and second electrode 48 within interior 41 and in direct contact with the printing fluid, extremely large capacitances may be formed. When two electrodes are placed in an ionic fluid and charged with opposite polarities, a layer of negative ions forms on the positively charged electrode, and a layer of positive ions forms on the negatively charged electrode. Furthermore, additional layers of positive and negative ions form on the innermost ion layers, forming alternating layers of oppositely charged ions extending outwardly into printing fluid 42 from each electrode. This charge structure is referred to as an electrical double layer (EDL), due to the double charge layer represented by the charges in the electrode and the charges in the first ion layer on the electrode surface. The EDL at each electrode acts effectively a capacitor, wherein the layer of ions acts as one plate and the electrode acts as the other plate. The effective circuit of the electrodes in the solution is shown generally at 60 in FIG. 3, wherein capacitor 64 represents the EDL at first electrode 46, and capacitor 66 represents the EDL at second electrode 48. Printing fluid 42 will also have an associated resistance, represented by resistor 68.

Due to the atomic-scale proximity of the ions to the electrode in the EDL, and to the fact that capacitance varies inversely with the distance of charge separation in a capacitor, extremely large capacitances per unit electrode surface area are generated in the EDLs associated with electrodes 46 and 48. The capacitances may be orders of magnitude larger than those possible with electrodes located external to the printing fluid. For example, where the surface areas and separation of first electrode 46 and second electrode 48 would be expected to result in a capacitance in the femptofarad range, capacitances in the nanofarad or microfarad range are observed. These large capacitances facilitate the measurement of the impedance of printing fluid 42 in printing fluid reservoir 30.

First electrode 46 and second electrode 48 may each have any suitable shape and size. For example, first electrode 46 and second electrode 48 may each have a plate-like configuration similar to that of a traditional capacitor, or a mesh-like configuration. However, the large capacitances generated at the EDL at each of first electrode 46 and second electrode 48 allow the electrodes to have smaller surface areas than if the electrodes were positioned external to interior 41 of printing fluid reservoir 30. Thus, rather than having a plate-like configuration of traditional capacitor electrodes, first electrode 46 and second electrode 48 may have thin, needle-like or wire-like shapes. The terms "needle-like" and "wire-like" are used herein to denote an elongate configuration in which a long dimension of the electrode is substantially greater than two shorter directions orthogonal to the long dimension and to each other. Such electrodes have been found to produce large capacitances that show clear variation with changes in printing fluid levels, types, etc., as explained in more detail below.

First electrode 46 and second electrode 48 may be made of any suitable electrically conductive material. Examples of suitable materials include, but are not limited to, metals such as stainless steel, platinum, gold and palladium. Alternatively, first electrode 46 and second electrode 48 may be made from an electrically conductive carbon material. Examples include, but are not limited to, activated carbon, carbon black, carbon fiber cloth, graphite, graphite powder, graphite cloth, glassy carbon, carbon aerogel, and cellulose-derived foamed carbon. To increase the conductivity of a carbon-based electrode, the carbon may be modified by oxidation. Examples of suitable techniques to oxidize the carbon include, but are not limited to, liquid-phase oxidations, gas-phase oxidations, plasma treatments, and heat treatments in inert environments.

In some embodiments, first electrode 46 and second electrode 48 may be coated with an electrically conductive coating. For example, first electrode 46 and second electrode 48 may be coated with a material having a high surface area-to-volume ratio to increase the effective surface area of the electrode. This may increase the capacitances that may be achieved with the electrode, as the electrode surface may accommodate more charge. The use of such a coating may allow smaller electrodes to be used without any sacrifice in measurement sensitivity. The use of a coating also may offer the further advantage of protecting the electrode material from corrosion by the printing fluid. Examples of suitable electrically conductive coatings include, but are not limited to, Teflon-based coatings (which may be modified with carbon), polypyrroles, polyanilines, polythiophenes, conjugated bithiazoles and bis-(thienyl) bithiazoles. Furthermore, the coating may be selectively crosslinked to reduce the level and type of adsorbed printing fluid components.

First electrode 46 and second electrode 48 may be coupled to body 40 in any suitable manner. In the depicted embodiment, first electrode 46 and second electrode 48 extend through body 40 of printing fluid reservoir 30 to a pair of external contacts, which are illustrated schematically in FIG. 2 as first contact 70 and second contact 72. Electrical contacts 70 and 72 may be configured to automatically form a connection with complementary contacts on printing device 10 (not shown) when printing fluid reservoir 30 is correctly mounted to printing device 10. This may enable printing fluid detector 32 to be easily connected to and disconnected from power supply 50 and detector circuitry 52 during printing reservoir removal and/or replacement.

As is well known in the electrical arts, a capacitor may cause a phase shift in an alternating signal, in that the current through the capacitor lags the voltage across the capacitor. This effect is observed with EDL capacitance. Thus, the phase shift of the supply signal measured at $e_{in}$ relative to the detected signal measured at $e_{out}$ may be used to determine the capacitance of first electrode 46 and second electrode 48 in the printing fluid.

Figure 4:
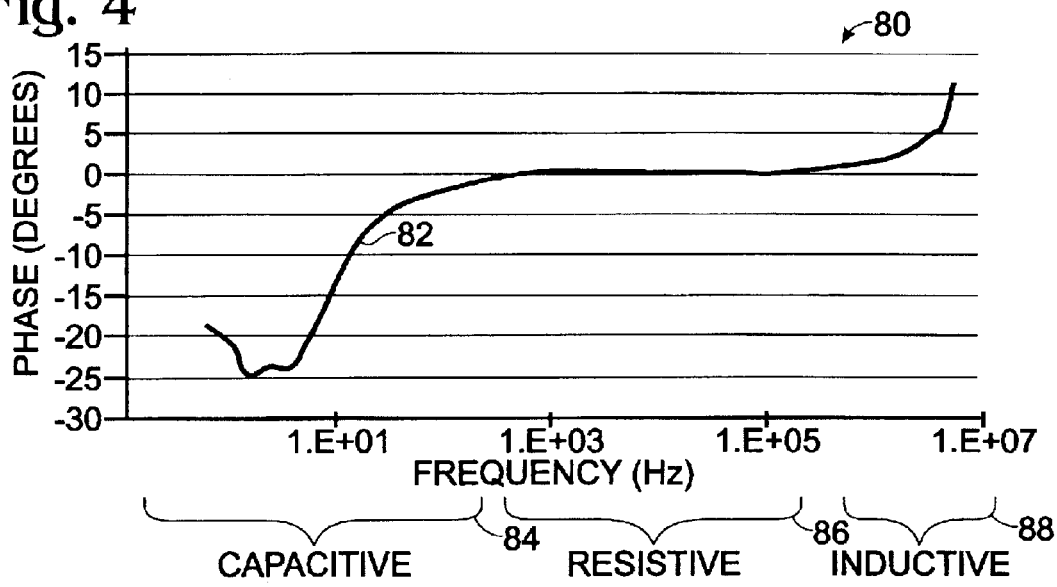
FIG. 4 is a graph showing a measured phase shift between $e_{in}$ and $e_{out}$ in the embodiment of FIG. 2 as a function of signal frequency.
Figure 5:
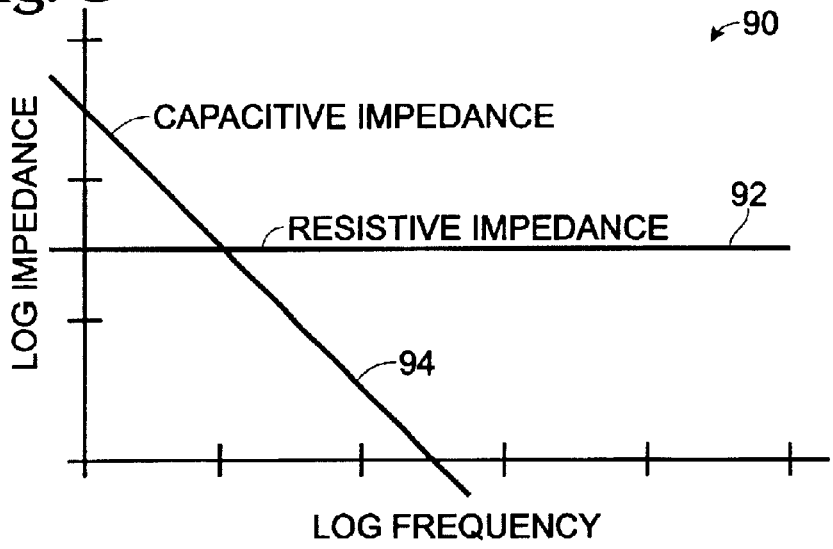
FIG. 5 is a log-log graph showing the relative contributions of capacitance and resistance to the total impedance of the embodiment of FIG. 2 as a function of signal frequency.

FIG. 4 shows, generally at 80, a graph depicting the observed phase shift of a signal in an exemplary printing fluid detector as a function of the log of the frequency of the signal. Line 82 is drawn through a plurality of data points (not shown) taken over a range of frequencies from approximately 1 Hz to approximately 1 MHz. The phase shift shows a first region 84 between approximately 1 Hz and approximately 1 kHz in which the phase shift varies significantly as a function of the frequency of the supply signal. Referring to FIG. 5, which shows a graph 90 illustrating the frequency dependence of the resistive component of the total impedance of the electrodes and printing fluid at 92 and the capacitive portion of the total impedance at 94, it can be seen that the capacitive portion dominates the total impedance at lower frequencies. Thus, the phase shift of the detected signal compared to the supply signal is expected to be greatest in this region.

Referring again to FIG. 4, the phase shift is seen to be essentially zero in a second, middle region 86 of graph 80, between approximately 1 kHz and 100 kHz. In this region, the capacitive and inductive portions of the impedance are negligible, while the resistive portion is dominant. Finally, the phase shift increases in a third, high-frequency region 88 of graph 80, above approximately 100 kHz. This phase shift is due to inductive effects. Thus, the capacitance of printing fluid 42 may be measured most sensitively in capacitive frequency region 84, between approximately 1 Hz and 1 kHz. While the phase shift is expected to be greatest at low frequencies, the use of frequencies in the range of 50–100 Hz still give large phase shifts, and also may enable the more rapid acquisition of data. Furthermore, the use of lower frequencies (<1 Hz) may result in the plating of the electrodes with metal ions present in printing fluid 42, whereas the use of higher frequencies may avoid the occurrence of plating.

Because the total capacitance of first electrode 46 and second electrode 48 is a function of the amount of charge stored on each electrode, the capacitance of the electrodes drops as the fluid level (and thus the size of each EDL) drops. This drop in capacitance with fluid level is observed as a decrease in the phase shift between the supply signal measured at $e_{in}$ and the detected signal measured at $e_{out}$.

Figure 6:
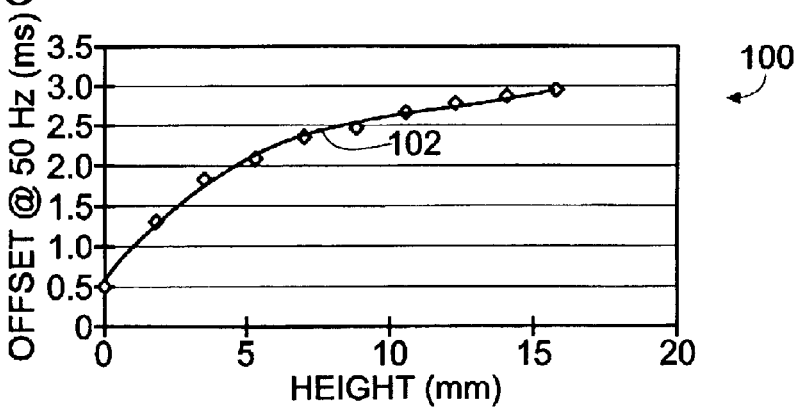
FIG. 6 is a graph showing a measured phase shift between $e_{in}$ and $e_{out}$ as a function of a printing fluid level in the printing fluid reservoir.

FIG. 6 shows, generally at 100, a graph depicting the dependence of the phase shift 102 between the supply signal and the detected signal as a function of printing fluid height at a frequency of 50 Hz. As the printing fluid height decreases, the phase shift also steadily decreases, decreasing more rapidly as the printing fluid level drops. The magnitude of the phase shift at each printing fluid level has been found to be accurately reproducible. This enables a look-up table of phase shifts and associated printing fluid levels to be constructed and stored in memory 51. Thus, processor 53 may be programmed to match a measured phase shift value to a closest phase shift value in the look-up table in memory 51, and then to determine the printing fluid level corresponding to the measured phase shift value. Furthermore, when printing fluid reservoir 30 is substantially emptied of printing fluid, the processor may be configured to detect an out-of-fluid condition via a comparison of a measured phase shift value with a phase shift value correlated with the out-of-fluid condition and stored in the look-up table in memory 51, and to communicate this condition to printing device controller 22.

Figure 7:
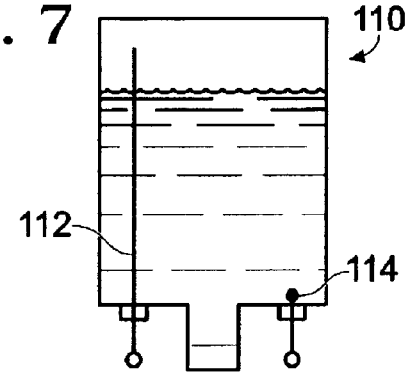
FIG. 7 is a schematic depiction of a second exemplary embodiment of the printing fluid reservoir and printing fluid detector of the embodiment of FIG. 1.
Figure 8:
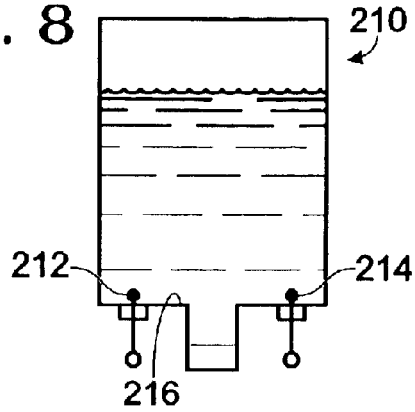
FIG. 8 is a schematic depiction of a third exemplary embodiment of the printing fluid reservoir and printing fluid detector of the embodiment of FIG. 1.

FIGS. 7 and 8 illustrate two other exemplary configurations for the first and second electrodes. First, FIG. 7 shows a printing fluid reservoir 110 having an elongate first electrode 112, and a short second electrode 114 disposed adjacent a bottom surface of the printing fluid reservoir. Because first electrode 112 extends substantially upward into the interior of printing fluid reservoir 110, the first electrode is incrementally exposed as the level of the printing fluid drops.

However, the second electrode remains covered until the printing fluid reservoir is substantially emptied of printing fluid. Because first electrode 112 is incrementally exposed, the overall capacitance of the first electrode and the second electrode drops along with a decrease in the printing fluid level. Thus, the configuration of FIG. 7 may be used to monitor a printing fluid level by monitoring the phase shift between the supply signal and the detected signal, as described above.

Second electrode 114 may have any suitable shape and size that allows it to remain covered with printing fluid until printing fluid reservoir 110 is substantially emptied of printing fluid. For example, second electrode 114 may have a flat configuration that is generally level with, or recessed in, the bottom of printing fluid reservoir 110. Alternatively, as depicted in FIG. 7, second electrode 114 may have a small, nub-like or bump-like shape. It will be appreciated that these shapes are described for illustrative purposes only, and that second electrode 114 may have any other suitable shape.

Next, FIG. 8 shows a printing fluid reservoir 210 having a short first electrode 212 and a short second electrode 214. Here, because both electrodes are disposed on a bottom surface 216 of printing fluid reservoir 210 and thus remain substantially covered with printing fluid until printing fluid reservoir 210 is substantially emptied of printing fluid, it may be difficult to measure the printing fluid level accurately through the entire range of printing fluid levels. However, the embodiment of FIG. 8 may be useful as an out-of-fluid detector configured to alert printing device controller 22 when printing fluid reservoir 210 is out of printing fluid. In this embodiment, memory 51 may include a look-up table with a phase shift value correlated to an out-of-fluid condition. Alternatively, detector circuitry 52 may include a simple threshold detector, as opposed to a look-up table, wherein the detector circuitry 52 detects an out-of-fluid condition when the measured impedance value crosses a predetermined threshold value correlated with the out-of-fluid condition.

Figure 9:
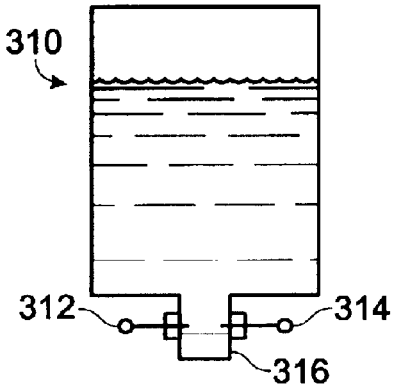
FIG. 9 is a schematic depiction of a fourth exemplary embodiment of the printing fluid reservoir and printing fluid detector of the embodiment of FIG. 1.

FIG. 9 shows another embodiment of an out-of-fluid detector, generally at 310. Like the embodiment of FIG. 8, the embodiment of FIG. 9 includes a first electrode 312 and a second electrode 314 having relatively short lengths. However, unlike the embodiment of FIG. 8, electrodes 312 and 314 of the embodiment of FIG. 9 are arranged in an outlet 316 of printing fluid reservoir 310. In this configuration, essentially all of the printing fluid in printing fluid reservoir may be emptied before electrodes 312 and 314 are exposed. Thus, placing electrodes 312 and 314 in outlet 316 may allow more printing fluid to be emptied from printing fluid reservoir 310 than placing the electrodes on the bottom surface of the printing fluid reservoir.

As described above, printing fluid detector 32 may be used to detect other printing fluid characteristics besides a printing fluid level and an out-of-fluid condition. For example, printing fluid detector 32 may be used to detect a printing fluid type. Different ionic printing fluids (as well as other types of fluids) typically have different metal cations ions, organometallic ions, and counterions, and also typically have different concentrations of ions, depending upon the color (and other physical characteristics) of the printing fluid.

Figure 10:
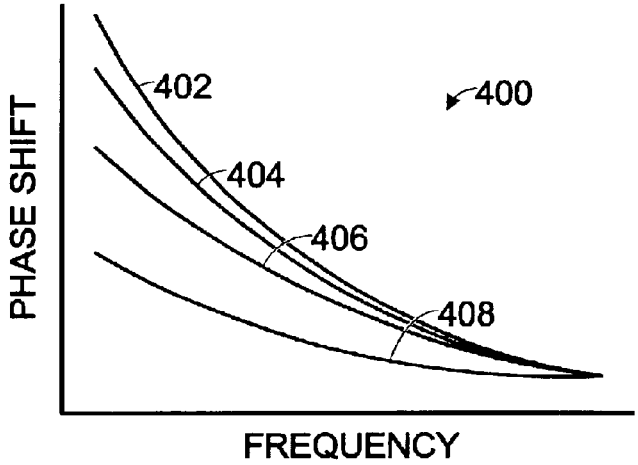
FIG. 10 is a graph showing a measured phase shift between $e_{in}$ and $e_{out}$ as a function of frequency for a plurality of different types of printing fluids.

The presence of different ions and/or different concentrations of ions may cause the electrodes to exhibit different impedance characteristics for different types of fluids. FIG. 10 shows, generally at 400, a graph demonstrating the relative magnitudes of the phase shifts measured for four different printing fluids: the top curve 402 represents an exemplary magenta printing fluid, the second curve 404 represents an exemplary yellow printing fluid, the third curve 406 represents an exemplary cyan printing fluid, and the bottom curve 408 represents an exemplary black printing fluid. As shown in graph 400, each printing fluid is distinguishable from the others across the entire frequency range by their respective measured phase shifts. Where the electrodes are sensitive to fluid levels, as with the embodiments of FIGS. 2 and 7, the phase shift measurement may be taken consistently at a selected fluid level to prevent variations in phase shift with printing fluid levels from interfering with fluid type considerations. Where the electrodes are less sensitive to the fluid level, as with the embodiments of FIGS. 8 and 9, a fluid type determination may be made at a much wider range of fluid levels.

Due to the differences in the phase shifts (at a selected frequency) between the different printing fluids, a printing fluid determination may be simple to implement. First, a predetermined phase shift value could be determined for each printing fluid supported by printing device 10. Next, a look-up table that contains a list of the printing fluids correlated to their predetermined phase shift values may be constructed and stored in memory 51. Finally, the phase shift value measured by printing fluid detector 32 may be compared to the phase shift values in the look-up table to determine which printing fluid corresponds to the measured phase shift value.

Given the wide variety of printing fluids available today, some printing fluids may exhibit phase shift values so similar that they are difficult to distinguish. To help reduce the possibility that a printing fluid is misidentified, more than one impedance value may be measured for a selected printing fluid, and memory 51 may contain a look-up table containing a list of printing fluids that are each correlated to more than one predetermined impedance value. For example, printing fluid detector 32 may be configured to first measure a phase shift value, and then a resistance value of the fluid.

Figure 11:
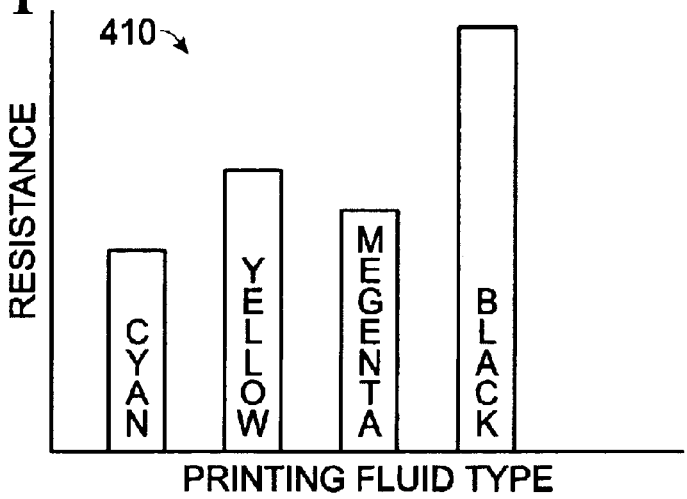
FIG. 11 is a bar graph showing measured resistances for a plurality of different printing fluids at a selected frequency.

Referring briefly back to FIGS. 4 and 5, at frequencies between approximately 1 kHz and 100 kHz, the capacitive component of the total impedance is essentially zero. Thus, the resistance of the printing fluid is the major component of the total impedance between these frequencies. It has been found that the printing fluid resistance may be accurately measured at these frequencies. Furthermore, it has been found that different printing fluids exhibit different fluidic resistances. Thus, the printing fluid resistance may be used to help identify a printing fluid type. A simple bar graph showing the variation in magnitude between the four printing fluids of FIG. 10 is shown generally at 410 in FIG. 11.

To implement this two-impedance-value measurement, a phase shift value may be measured at a first, lower frequency, and then a resistance value may be measured at a higher frequency. Next, processor 53 may look for a fluid in the look-up table in memory 51 that has impedance values which most closely match each of the impedance values measured for the printing fluid in the printing fluid reservoir. Alternatively, two different phase shift values may be measured at two different frequencies, and the look-up table may include two predetermined phase shift values for each fluid type. Furthermore, a phase shift and total impedance may be measured at a single frequency. It will be appreciated that these combinations of impedance values are merely exemplary, and that any other suitable combination of impedance values may be used in a printing fluid type determination.

The fluid resistance also may be used with any of the embodiments of FIGS. 2, 7, 8 or 9 to determine an out-of-fluid condition, or with the embodiments of FIGS. 2 and 7 to determine a printing fluid level. As described above, the fluidic resistance measurement may be made at a frequency between approximately 1 kHz and 100 kHz to reduce the capacitive component of the total impedance of the electrodes and the printing fluid. A resistance value may be determined by measuring the voltage drop at $e_{out}$ (of FIG. 2), combined with measuring the current flowing through the circuit. A resistor (not shown) may be used in parallel with the fluidic resistance to help in the calculation and/or measurement of the voltage drop. The measured resistance value could then be compared to a look-up table containing a plurality of pre-determined printing fluid levels correlated with predetermined fluidic resistance values to determine the printing fluid level, as described above for the phase shift embodiments.

The determination of printing fluid resistance values at frequencies between 1 kHz and 100 kHz has been found to be a quick and reliable method of determining printing fluid levels, printing fluid types and out-of-fluid conditions. Furthermore, the resistance measurements have been found to be sensitive, and to allow the resistance of printing fluid to be distinguished from residual printing fluid froth of a wide range of densities and concentrations that may be left in the printing fluid reservoir after the printing fluid has been emptied.

One difficulty that may be encountered in using capacitance/phase shift and/or resistance measurements to determine an out-of-fluid condition is that, for some printing fluids, the resistance and capacitance (and therefore, the phase shift) measurements may be dependent to various degrees upon the temperature of the printing fluid in the printing fluid reservoir. Ordinarily, the differences in the capacitance/resistance of the printing fluid and electrodes as compared to air is sufficiently different that any minor variations in the capacitance/resistance of the fluid as a function of temperature may not effect the out-of-fluid determination. However, in some situations, the residual froth left over inside of a printing fluid reservoir after the printing fluid reservoir is substantially emptied of printing fluid may have a resistance similar to the resistance of the printing fluid.

Figure 12:
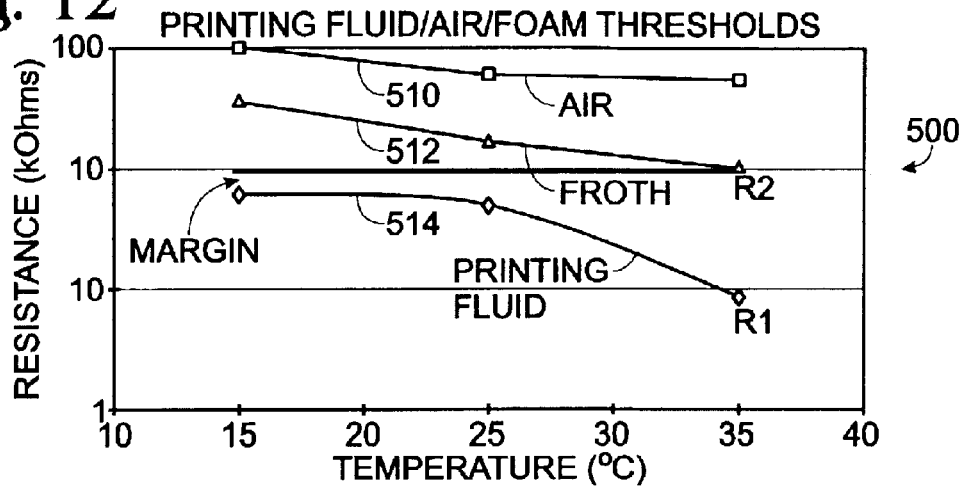
FIG. 12 is a graph showing the temperature dependence of resistance measurements for air, froth and printing fluid.

The resistances of air, froth and printing fluid in an exemplary printing fluid detector 32 are shown at 510, 512 and 514, respectively, in graph 500 of FIG. 12. Typically, it is desirable to indicate an out-of-fluid condition when only froth is present in the printing fluid reservoir. However, it can be seen that the margin between the resistance of froth at 35 degrees Celsius and the resistance of the printing fluid at 15 degrees Celsius is fairly narrow, and thus may be difficult for printing fluid detector 32 to distinguish.

To compensate, the following temperature calibration may be performed periodically to ensure that detector circuitry 52 is able to determine that a correct froth threshold is used for the current temperature. First, the resistances of the printing fluid and froth are experimentally determined over a range of temperatures, and the determined values are recorded in a look-up table stored in memory 51. Next, a series of resistance measurements are taken, and the standard deviation of the measured values is determined. It has been found that a series of resistance measurements taken from a printing fluid reservoir containing froth has a much higher standard deviation (on the order of 100:1) than a series of resistance measurements taken from a printing fluid reservoir containing printing fluid, which consistently exhibits very low standard deviations. Thus, if the standard deviation of the series of resistance measurements is high, then the printing fluid reservoir is determined to contain froth, and no temperature recalibration is performed. On the other hand, if the standard deviation of the series of resistance measurements is low, then the printing fluid reservoir is determined to contain printing fluid, and the temperature corresponding to the measured printing fluid resistance is located in the look-up table. Finally, the froth resistance corresponding to the determined temperature is set as a new out-of-fluid threshold resistance value.

The resistance value corresponding to froth may be updated at any desired frequency. For example, the value may be updated as infrequently as once an hour, or even less frequently. Likewise, the value may be updated as frequently as once every few seconds. However, the value is more typically updated every few minutes. Updating the resistance value corresponding to froth every few minutes helps to ensure that the value is updated over a shorter timeframe than typical changes in temperature, yet is not updated so often as to consume printing device resources to a detrimental extent.

Some printing devices may include a bipolar analog power supply that may be used to produce the alternating supply signal. However, other printing devices may not utilize bipolar voltages, but instead may only have a unipolar voltage source, such as a digital clock signal. The application of such a unipolar voltage source across the electrodes may cause metal ions to plate on the electrodes, which may result in the production of gasses. These gasses may be detrimental to the properties of the printing fluid, and also may cause unwanted pressure to build within printing fluid reservoir 32.

Figure 13:
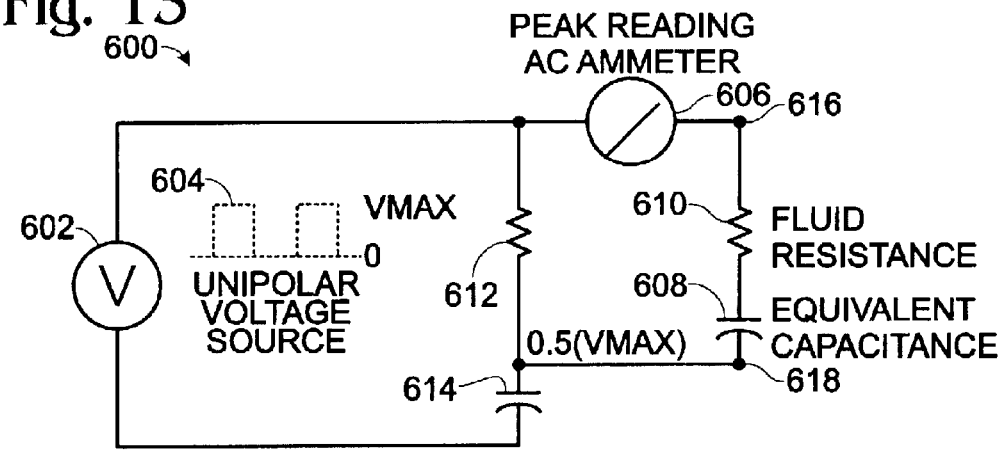
FIG. 13 is a schematic diagram of a first exemplary circuit suitable for producing a bipolar signal from a unipolar voltage source.
Figure 14:
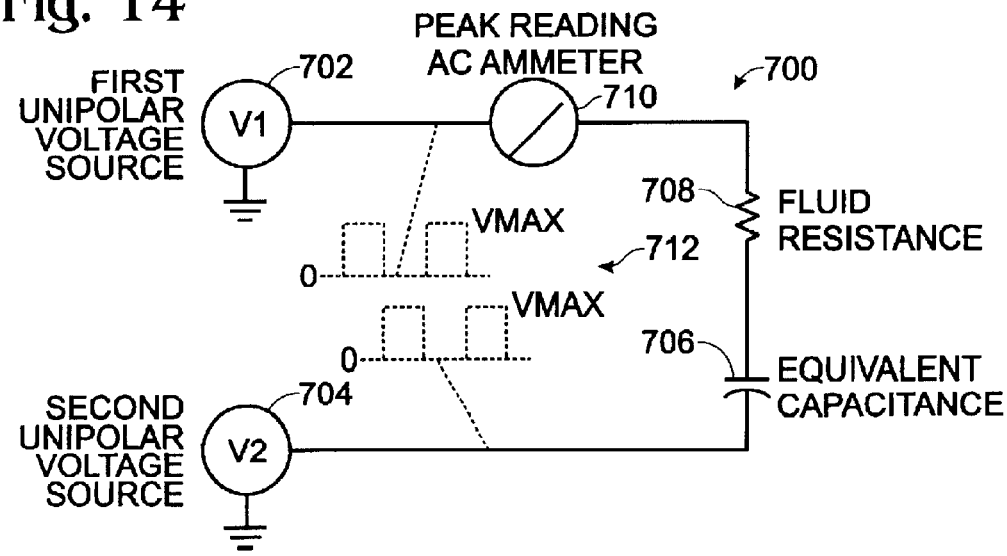
FIG. 14 is a schematic diagram of a second exemplary circuit suitable for producing a bipolar signal from a unipolar voltage source.

To avoid the expense of providing bipolar voltage sources in devices that would not otherwise have them, circuitry may be provided that creates a bipolar signal from a unipolar source. FIGS. 13 and 14 show two exemplary circuits that may be used to produce a bipolar voltage from one or more unipolar voltage sources.

First, FIG. 13 shows, generally at 600, a circuit that utilizes a single unipolar alternating voltage source 602 to generate a bipolar signal across the first and second electrodes. Voltage source 602 is configured to output a digital bi-level unipolar voltage, as shown in diagram 604. Besides voltage source 602, circuit 600 also includes a peak reading AC ammeter 606 positioned below the junction at which the current splits to flow through resistor 612 and the electrodes and printing fluid to allow the calculation of an impedance value of the printing fluid. Capacitor 608 (labeled "equivalent capacitance"), and resistor 610 (labeled "fluid resistance") together represent the impedance of the first electrode, second electrode and printing fluid.

Circuit 600 also includes a resistor 612 in parallel with the fluidic impedance, and a capacitor 614 located below the junction at which the currents through resister 612 and the fluid resistance 610 rejoin. The values of resistor 612 and capacitor are 614 selected such that the RC time constant of capacitor 614 and resistor 612 is larger than the frequency of voltage source 602, and such that the voltage at capacitor 614 remains at approximately one half of the maximum output voltage of voltage source 602. Thus, when voltage source 602 is outputting a positive voltage, the voltage at point 616 is more positive than the voltage at point 618. On the other hand, when voltage source 602 is outputting 0 V, capacitor 614 holds point 618 at a more positive voltage than point 616. In this manner, the first and second electrodes alternate as the most positive electrode, helping to avoid the electrochemical reduction of metal ions on the electrodes, and thus helping to avoid plating and gas production problems.

Next, FIG. 14 shows a circuit 700 that utilizes two unipolar voltage sources to create a bipolar signal across the first and second electrodes. Circuit 700 includes a first unipolar voltage source 702 connected to one electrode, and a second unipolar voltage source 704 connected to the other electrode. The impedance of the first electrode, second electrode and printing fluid is represented by capacitor 706 (labeled "equivalent capacitance") and resistor 708 (labeled "fluid resistance"). Circuit 700 may include an ammeter 710 to allow the current through the electrodes and printing fluid to be measured, and thus to allow a measured impedance value to be calculated.

The signals supplied by voltage sources 702 and 704 are configured to be 180 degrees out of phase, as shown in phase diagram 712. Thus, whenever the signal from voltage source 702 is high, the signal from voltage source 704 is low and vice versa. This causes the polarities of the two electrodes to be reversed periodically, and thus helps to avoid plating problems and unwanted production of gases in the printing fluid reservoir.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A fluid supply, comprising:

a body defining an interior volume configured to contain a fluid;

a first electrode and a second electrode contained within the interior volume and configured to be in direct contact with the fluid, wherein the first electrode and second electrode are configured to be connected to external power supply circuitry for applying an alternating signal across the first and second electrodes, and wherein at least one of the first electrode and the second electrode has an elongate shape extending at least partially upwards from a bottom surface of the interior volume to enable the detection of a level of the fluid in the interior volume; and a first electrical contact in electrical communication with the first electrode and a second electrical contact in electrical communication with the second electrode, wherein the first electrical contact and second electrical contact are configured to be connected to the external power supply circuitry and to detector circuitry for determining a measured impedance value of the fluid to detect a characteristic of the fluid.

2. The fluid supply of claim 1, wherein at least one of the first electrode and second electrode has a needle-like shape.

3. The fluid supply of claim 1, the interior volume having a height, wherein at least one of the first electrode and second electrode extends substantially the height of the interior volume.

4. The fluid supply of claim 1, wherein the electrodes are at least partially made of a material selected from the group consisting of stainless steel, gold, palladium, activated carbon, carbon black, carbon fiber cloth, graphite, graphite powder, graphite cloth, glassy carbon, carbon aerogel, and cellulose-derived foamed carbon.

5. The fluid supply of claim 4, wherein the electrodes are made of a carbon material modified by a technique selected from the group consisting of liquid-phase oxidations, gas-phase oxidations, plasma treatments, and heat treatments in inert environments.

6. A fluid supply, comprising:

a body defining an interior volume configured to contain a fluid;

a first electrode and a second electrode contained within the interior volume and configured to be in direct contact with the fluid, wherein the first electrode and second electrode are configured to be connected to external power supply circuitry for applying an alternating signal across the first and second electrodes, and wherein each of the first and second electrodes extends upwards from the bottom surface of the interior volume; and a first electrical contact in electrical communication with the first electrode and a second electrical contact in electrical communication with the second electrode, wherein the first electrical contact and second electrical contact are configured to be connected to the external power supply circuitry and to detector circuitry for determining a measured impedance value of the fluid to detect a characteristic of the fluid.

7. A fluid supply, comprising:

a body defining an interior volume configured to contain a fluid;

a first electrode and a second electrode contained within the interior volume end configured to be in direct contact with the fluid, wherein the first electrode and second electrode are configured to be connected to external power supply circuitry for applying an alternating signal across the first and second electrodes, and wherein each of the first and second electrodes has a low profile that remains covered by fluid until the interior volume is substantially emptied of fluid; and a first electrical contact in electrical communication with the first electrode and a second electrical contact in electrical communication with the second electrode, wherein the first electrical contact and second electrical contact are configured to be connected to the external power supply circuitry and to detector circuitry for determining a measured impedance value of the fluid to detect a characteristic of the fluid.

8. A fluid supply, comprising:

a body defining an interior volume configured to contain a fluid, wherein the body includes a fluid outlet;

a first electrode and a second electrode contained within the interior volume and configured to be in direct contact with the fluid, wherein the first electrode and second electrode are configured to be connected to external power supply circuitry for applying an alternating signal across the first and second electrodes, and wherein the first and second electrodes are disposed in the outlet of the interior volume; and a first electrical contact in electrical communication with the first electrode and a second electrical contact in electrical communication with the second electrode, wherein the first electrical contact and second electrical contact are configured to be connected to the external power supply circuitry and to detector circuitry for determining a measured impedance value of the fluid to detect a characteristic of the fluid.

9. The fluid supply of claim 8, the outlet having a bottom, wherein the first and second electrodes are disposed in the outlet of the interior volume at a substantially equal height above the bottom of the outlet.

10. A fluid supply, comprising:

a body defining an interior volume configured to contain a fluid;

a first electrode and a second electrode contained within the interior volume and configured to be in direct contact with the fluid, wherein the first electrode and second electrode are configured to be connected to external power supply circuitry for applying an alternating signal across the first and second electrodes, and wherein the electrodes are coated with an electrically conductive polymer film; and a first electrical contact in electrical communication with the first electrode and a second electrical contact in electrical communication with the second electrode, wherein the first electrical contact and second electrical contact are configured to be connected to the external power supply circuitry and to detector circuitry for determining a measured impedance value of the fluid to detect a characteristic of the fluid.

11. The fluid supply of claim 10, wherein the electrically conductive polymer film is selected from the group consisting of polypyrroles, polyanilines, polythiophenes, conjugated bithiazoles and bis-(thienyl) bithiazoles.

12. A printing device configured to print a printing fluid onto a printing medium, the printing device comprising:

a printing fluid reservoir configured to hold the printing fluid; and a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal with a frequency of between approximately 1 Hz and 1 kHz across the first and second electrodes and detector circuitry configured to measure capacitance of the first electrode and the second electrode as a function of the printing fluid by measuring a phase shift between an applied voltage at the first electrode and a detected voltage at the second electrode, and thereby to determine at least one of a printing fluid level, a printing fluid type, and an out-of-fluid condition.

13. A printing device configured to print a printing fluid onto a printing medium, the printing device comprising:

a printing fluid reservoir configured to hold the printing fluid; and a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal at a frequency of between approximately 1 kHz and 100 kHz across the first and second electrodes, and detector circuitry configured to measure resistance of the printing fluid to determine at least one of a printing fluid level, a printing fluid type, and an out-of-fluid condition.

14. A printing device configured to print a printing fluid onto a printing medium, the printing device comprising:

a printing fluid reservoir configured to hold the printing fluid; and a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal across the first and second electrodes, and detector circuitry configured to measure a measured impedance value of the printing fluid to determine at least one of a printing fluid level, a printing fluid type, and an out-of-fluid condition;

wherein at least one of the first electrode and the second electrode has an elongate shape extending at least partially upwards from a bottom surface of the painting fluid reservoir to enable the detection of a level of the printing fluid in the painting fluid reservoir.

15. The printing device of claim 14, wherein at least one of the first electrode and the second electrode has a needle-like shape.

16. The printing device of claim 14, wherein both electrodes extend upwards from the bottom surface of the printing fluid reservoir.

17. The printing device of claim 14, wherein each of the electrodes has a low profile that remains covered by printing fluid until the printing fluid reservoir is substantially emptied of printing fluid.

18. The printing device of claim 14, wherein the electrodes include a material selected from the group consisting of stainless steel, platinum, gold, palladium, activated carbon, carbon black, carbon fiber cloth, graphite, graphite powder, graphite cloth, glassy carbon, carbon aerogel, and cellulose-derived foamed carbon.

19. The printing device of claim 18, wherein the electrodes are made of a carbon material modified by a technique selected from the group consisting of liquid-phase oxidations, gas-phase oxidations, plasma treatments, and heat treatments in inert environments.

20. A printing device configured to print a printing fluid onto a printing medium, the printing device comprising:

a printing fluid reservoir configured to hold the printing fluid, wherein the printing fluid reservoir includes an outlet; and a printing fluid detector associated with the printing fluid reservoir, wherein the printing fluid detector includes a first electrode and a second electrode disposed within the printing fluid reservoir and configured to be in direct contact with the printing fluid, and wherein the first and second electrodes are disposed in the outlet of the printing fluid reservoir, the printing fluid detector further including power supply circuitry configured to apply an alternating signal across the first and second electrodes, and detector circuitry configured to measure a measured impedance value of the printing fluid to determine at least one of a printing fluid level, a printing fluid type, and an out-of-fluid condition.

21. The printing device of claim 20, the outlet having a bottom, wherein the first and second electrodes are disposed in the outlet of the printing fluid reservoir at a substantially equal height above the bottom of the outlet.

22. A printing device configured to print a printing fluid onto a printing medium, the printing device comprising:

a printing fluid reservoir configured to hold the printing fluid;

a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal across the first and second electrodes, and detector circuitry configured to measure a measured impedance value of the printing fluid to determine at least one of a printing fluid level, a printing fluid type, and an out-of-fluid condition; and a processor operatively linked to a memory, the memory containing a set of instructions executable by the processor to compare the measured impedance value to a plurality of predetermined impedance values stored in the memory and correlated with specific printing fluids to identify the printing fluid.

23. The printing device of claim 22, wherein the instructions are executable by the processor to compare a set of at least two measured impedance values of the printing fluid to a plurality of predetermined sets of at least two impedance values stored in the memory and correlated with specific printing fluids to identify the printing fluid.

24. The printing device of claim 23, wherein the set of at least two measured impedance values includes a printing fluid resistance and a printing fluid capacitance.

25. The printing device of claim 23, wherein the set of at least two measured impedance values includes a phase shift measured at a first frequency and a phase shift measured at a second frequency.

26. The method of claim 23, wherein the set of at least two measured impedance values includes a phase shift and an amplitude measured at a single frequency.

27. A printing device configured to print a printing fluid onto a printing medium, the printing device comprising:

a printing fluid reservoir configured to hold the printing fluid;

a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal across the first and second electrodes, and detector circuitry configured to measure a measured impedance value of the printing fluid to determine at least one of a printing fluid level, a printing fluid type, and an out-of-fluid condition; and a processor operatively linked to a memory, the memory containing a set of instructions executable by the processor to compare the measured impedance value to a plurality of impedance values stored in the memory and correlated to specific fluid levels to determine a current fluid level.

28. A printing device configured to print a printing fluid onto a printing medium, the printing device comprising:

a printing fluid reservoir configured to hold the printing fluid wherein the printing fluid is an ionic printing fluid; and a printing fluid detector associated with the printing fluid reservoir, wherein the printing fluid detector includes a first electrode and a second electrode disposed within the printing fluid reservoir and configured to be in direct contact with the printing fluid, power supply circuitry configured to apply an alternating signal across the first and second electrodes, and detector circuitry configured to measure a measured impedance value of the printing fluid to determine at least one of a printing fluid level, a printing fluid type, and an out-of-fluid condition.

29. A printing device configured to print a printing fluid onto a printing medium, the printing device comprising:

a printing fluid reservoir configured to hold the printing fluid; and a printing fluid detector associated with the printing fluid reservoir, wherein the printing fluid detector includes:

a first electrode and a second electrode coated with an electrically conductive polymer film, the electrodes being disposed within the printing fluid reservoir and configured to be in direct contact with the printing fluid, power supply circuitry configured to apply an alternating signal across the first and second electrodes, and detector circuitry configured to measure a measured impedance value of the printing fluid to determine at least one of a printing fluid level, a printing fluid type, and an out-of-fluid condition.

30. The printing device of claim 29, wherein the electrically conductive polymer film is selected from the group consisting of Teflon-based coatings, polypyrroles, polyanilines, polythiophenes, conjugated bithiazoles and bis-(thienyl) bithiazoles.

31. A method of monitoring a printing fluid in a printing fluid supply, the printing fluid supply including an enclosed volume configured to contain a supply of a printing fluid, and a first electrode and a second electrode disposed within the enclosed volume and configured to be in direct contact with the printing fluid, the method comprising:

applying an alternating supply signal to the first and second electrodes;

detecting a detected signal at the first electrode;

determining a measured impedance value of the printing fluid by comparing the supply signal to the detected signal; and comparing the measured impedance value to a plurality of previously determined impedance values correlated to known printing fluid properties to determine an unknown printing fluid property.

32. The method of claim 31, wherein determining a measured impedance value includes determining a measured capacitance of the first electrode and second electrode as a function of the printing fluid by determining a measured phase shift between the supply signal and the detected signal.

33. The method of claim 32, wherein the alternating supply signal has a frequency of 1 Hz and 1 kHz.

34. The method of claim 32, wherein the plurality of previously determined impedance values includes a plurality of previously determined phase shifts that are correlated to specific printing fluid levels, and wherein the measured phase shift is compared to the plurality of previously determined phase shifts to determine a current printing fluid level.

35. The method of claim 32, wherein the plurality of previously determined impedance values includes a plurality of previously determined phase shifts correlated to specific types of printing fluids, and wherein the measured phase shift is compared to the plurality of previously determined phase shifts to determine a current printing fluid type.

36. The method of claim 31, wherein determining a measured impedance value includes determining a measured resistance of the printing fluid.

37. The method of claim 36, wherein the plurality of previously determined impedance values include a plurality of previously determined resistances correlated to specific types of printing fluids, and wherein the measured resistance is compared to the plurality of previously determined resistances to determine a current printing fluid type.

38. The method of claim 36, wherein the plurality of previously determined impedance values includes a first resistance value correlated to a presence of printing fluid and a second resistance value correlated to an absence of printing fluid, and wherein the measured resistance is compared to the first resistance value and the second resistance value to determine whether the printing fluid supply is out of printing fluid.

39. The method of claim 31, wherein determining a measured impedance value includes determining two different measured impedance characteristics for the printing fluid.

40. The method of claim 39, wherein the two different measured impedance characteristics include a measured printing fluid resistance and a measured printing fluid capacitance.

41. The method of claim 39, wherein the two different measured impedance characteristics include a phase shift measured at a first frequency and a phase shift measured at a second frequency.

42. The method of claim 39, wherein the two different measured impedance characteristics include a phase shift value and a total impedance value measured at a single frequency.

43. A method of detecting a printing fluid level in a printing fluid supply, the printing fluid supply including an enclosed volume configured to contain a supply of a printing fluid, and a first electrode and a second electrode in contact with the printing fluid, at least one of the first electrode and second electrode extending upwardly into the enclosed volume from a bottom portion of the enclosed volume, the method comprising:

applying an alternating supply signal to the first and second electrodes;

detecting a detected signal at the first electrode;

determining a measured phase shift between the supply signal and the detected signal; and comparing the measured phase shift to a set of previously determined phase shifts that are correlated with known printing fluid levels to determine a current printing fluid level.

44. The method of claim 43, wherein applying an alternating signal to the first electrode includes applying an alternating signal having a frequency between approximately 1 Hz and 1 kHz.

45. A method of determining a type of fluid in a container, the container including a fluid-holding volume, and a first electrode and a second electrode disposed within fluid-holding the volume and configured to be in contact with a fluid in the container, the method comprising:

applying an alternating supply signal to the first and second electrodes;

detecting a detected signal at the first electrode;

determining a measured impedance value related to the fluid via a comparison of the supply signal and the detected signal; and comparing the measured impedance value to a plurality of previously determined impedance values that are correlated with known types of fluids to determine the type of fluid in the container.

46. The method of claim 45, wherein the fluid is a printing fluid, and wherein the container is a printing fluid container.

47. The method of claim 45, wherein determining a measured impedance value related to the fluid includes determining a capacitance of the electrodes as a function of the fluid.

48. The method of claim 47, wherein determining the capacitance of the electrodes as a function of the fluid includes determining a phase shift between the supply signal and the detected signal.

49. The method of claim 45, wherein determining a measured impedance value related to the fluid includes determining a set of at least two measured impedance characteristics related to the fluid.

50. The method of claim 49, wherein the set of at least two measured impedance characteristics related to the fluid includes a phase shift value and a resistance value.

51. The method of claim 49, wherein the set of at least two measured impedance characteristics related to the fluid includes a phase shift value and a total impedance value measured at a single frequency.

52. The method of claim 49, wherein the set of at least two measured impedance characteristics related to the fluid includes two measured phase shift values measured at two different frequencies.

* * * * *

UNITED STATES PATENT AND TRADEMARK OFFICE

CERTIFICATE OF CORRECTION

PATENT NO. : 6,929,343 B2
APPLICATION NO. : 10/425355
DATED : August 16, 2005
INVENTOR(S) : Farr et al.

It is certified that error appears in the above-identified patent and that said Letters Patent is hereby corrected as shown below:

IN THE CLAIMS

Col. 14 (line 24), delete “painting” and insert therefor --printing--.

Signed and Sealed this

Fifteenth Day of August, 2006

JON W. DUDAS
*Director of the United States Patent and Trademark Office*